US008502639B1

(12) United States Patent
Coffey et al.

(10) Patent No.: US 8,502,639 B1
(45) Date of Patent: Aug. 6, 2013

(54) NANOCOMPOSITE SEMICONDUCTING MATERIAL WITH REDUCED RESISTIVITY

(75) Inventors: Kevin R. Coffey, Oviedo, FL (US); Vu Huynh Lam, Winter Springs, FL (US); Edward Dein, Saint Cloud, FL (US); Andrew P. Warren, Cocoa, FL (US); Glenn Boreman, Geneva, FL (US); Guy Zummo, Orlando, FL (US); Wilson Caba, Orlando, FL (US)

(73) Assignee: University of Central Florida Research Foundation, Inc., Orlando, FL (US)

( * ) Notice: Subject to any disclaimer, the term of this patent is extended or adjusted under 35 U.S.C. 154(b) by 0 days.

(21) Appl. No.: 13/554,591

(22) Filed: Jul. 20, 2012

Related U.S. Application Data

(62) Division of application No. 12/253,413, filed on Oct. 17, 2008, now Pat. No. 8,228,159.

(60) Provisional application No. 60/981,238, filed on Oct. 19, 2007.

(51) Int. Cl.
*H01C 7/10* (2006.01)

(52) U.S. Cl.
USPC ..... 338/22 R; 338/20

(58) Field of Classification Search
USPC ..... 338/20, 22 R; 428/611, 620
See application file for complete search history.

(56) References Cited

U.S. PATENT DOCUMENTS

| | | | |
|---|---|---|---|
| 3,629,671 | A | 12/1971 | Sunano |
| 3,886,578 | A | 5/1975 | Eastwood |
| 5,558,680 | A | 9/1996 | Takeuchi |
| 6,514,453 | B2 | 2/2003 | Vigliotti |
| 6,641,775 | B2 | 11/2003 | Vigliotti |
| 6,961,168 | B2 | 11/2005 | Agrawal |
| 2002/0132101 | A1 | 9/2002 | Fonash |
| 2004/0005483 | A1 | 1/2004 | Lin |
| 2004/0108628 | A1 | 6/2004 | Yadav |
| 2004/0161949 | A1 | 8/2004 | Yadav |
| 2004/0180203 | A1 | 9/2004 | Yadav |
| 2006/0068080 | A1 | 3/2006 | Yadav |

OTHER PUBLICATIONS

Zintu, et al., Dual Ion Beam Sputtering Vanadium Dioxide Microbolometers by Surface Micromaching, Infrared Physics & Technology, 2002, pp. 245-250, vol. 43.

Kruse, Uncooled Thermal Energy Arrays: Systems and Applications, Chapter 4: Resistive Bolometers, STIE Press, 2002, pp. 33-48.

Lam, Electrical Properties of Reactive Magnetron Sputtered Vanadium Oxide thin Films, Master Thesis, University of Central Florida, School of Electrical Engineering and Computer Science, Orlando, FL, 2006, 64 pages, unpublished.

*Primary Examiner* — Kyung Lee

(74) *Attorney, Agent, or Firm* — Brian S. Steinberger; Phyllis K. Wood; Law Offices of Brian Steinberger, P.A.

(57) ABSTRACT

A resistor, fabricating method, and thermal sensor material for resistors that incorporate high Temperature Coefficient of Resistance (TCR) values and low resistivity for better sensitivity in infrared imaging applications are disclosed. Amorphous oxide thin films, preferably oxides of vanadium ($VO_x$), were deposited on thermally grown silicon dioxide by direct current (DC) magnetron co-sputtering of noble metals (gold and platinum) in a controlled argon/oxygen atmosphere. The ideal conditions for preparing an amorphous vanadium oxide/noble metal thin film are identified. TCR and resistivity results showed that the additions of gold (Au) and platinum (Pt) into $VO_x$ reduced the resistivity. However, only gold (Au) was found to improve TCR value. Reducing the amount of oxygen in the thin film, further improved the ratio between TCR and resistivity. Infrared detection and imaging devices can be greatly improved with a "drop-in" amorphous vanadium oxide/noble metal thin film of the present invention.

20 Claims, 20 Drawing Sheets

NANOCOMPOSITE SEMICONDUCTING MATERIAL WITH REDUCED RESISTIVITY

This application is a divisional application of U.S. patent application Ser. No. 12/253,413 filed on Oct. 17, 2008 now U.S. Pat. No. 8,228,159 which claims the benefit of priority from U.S. Provisional Patent Application Ser. No. 60/981,238 filed Oct. 19, 2007, which is incorporated herein by reference.

FIELD OF THE INVENTION

This invention relates to semiconducting materials, and in particular to improvements in conventional amorphous semiconducting materials used as temperature dependent resistors and in micro-bolometers to increase sensitivity for infrared imaging and detection.

BACKGROUND AND PRIOR ART

In the past, infrared imaging and detection was mainly of interest for photon detectors used in military applications. Infrared photon detectors have excellent performance in their detection range and response time, but are very expensive and must be cooled at cryogenic temperature to insure high performance.

With today's heightened interest in security and surveillance, the civilian sector requires infrared detection and imaging; thus the market is asking for devices at lower cost. Microbolometers have become the instrument of choice for infrared imaging and detection because they are cheap and can reach quite good performances with a detection range and a response time good enough for civil applications.

The microbolometer infrared imaging industry is estimated to have a value of several hundred million dollars annually. Microbolometers are thermal sensors that operate on the principle that radiation is absorbed by a sensible material that turns temperature changes into measurable resistance changes. To have the highest sensibility, the thermal conductance between the sensible film and the substrate must be minimized. Thus, the sensible film of microbolometers is deposited on a suspended thermally insulating membrane, such as silicon nitride. To have a fast response time, the thermal capacity must be minimized.

Infrared images are maps of heat or thermal radiation. Each temperature range is assigned a visible light color to represent it, allowing the infrared measurements to be translated into an image that we can see. For example, infrared cameras detect heat radiation that can be used to "see" the heat from warm blooded animals—even at night. Deer in a forest would be invisible to an ordinary human eye or to an ordinary camera. However, an infrared camera can capture an image of such an animal that cannot be obtained from a visible light image.

FIG. 1 is an example of an infrared image. Notice the light and dark contrast of the street scene. Heated objects are light colored and cool objects are dark. Notice the contrast between the street surface which is much warmer than the vehicles moving over the surface. Notice the two vehicles on the left side of the photo about to turn right at the intersection; the contrast between the automobile and the relatively cool window glass which does not radiate much infrared light. This conveys information that the windows in both vehicles are closed. The image in FIG. 1 gives us a different view of a familiar scene, as well as information that we could not obtain from a visible light photo.

The following references reveal the state of the art in the use of semiconducting materials related to infrared imaging.

U.S. Pat. No. 6,961,168 to A. Agrawal, et al. describes durable electrooptic devices comprising ionic liquids.

U.S. Pat. No. 6,514,453 to Vigliotti et al discloses thermal sensors prepared from nanostructured powders.

U.S. Pat. No. 6,641,775 to Vigliotti et al describes reducing manufacturing and raw material costs for device manufactured with nanostructured powders.

U.S. Patent Publication 2002/0132101 to Fonash et al describes deposited thin film void-column network materials comprising a network of silicon columns in a continuous void creating a porous continuous film.

U.S. Patent Publication 2004/0005483 to Lin describes perovskite manganites for use in coatings for blocking electromagnetic interference fields (EMIs).

U.S. Patent Publication 2004/0108628 to Yadav et al describes nanostructured devices from ceramic nanomaterials.

U.S. Patent Publication 2004/0180203 to Yadav et al discloses nanomaterial compositions with distinctive shape and morphology.

U.S. Patent Publication 2004/0161949 to Yadav et al discloses semiconductor and device nanotechnology and methods for their manufacture.

U.S. Patent Publication 2006/0068080 to Yadav et al discloses combinatorial discovery of nanomaterials.

D. Zintu et al in "Dual Ion Beam Sputtering Vanadium Dioxide Microbolometers by Surface Micromachining" *Infrared Physics & Technology* 43 (2002) pages 254-250 describes microbolometer prototypes that are prepared using amorphous vanadium dioxide as the sensible material. The prototypes performances are close to the state of the art with detection range and response time of a few milliseconds.

The use of vanadium oxides as semiconductor materials in bolometers is discussed by Paul W. Kruse in *Uncooled Thermal Energy; Arrays, Systems and Applications*, Chapter 4, "Resistive Bolometers," STIE Press, Bellingham Wash. (2002).

Improvements in semiconductor materials and other material applications require a basic improvement over normal physical limitations. It would be desirable to have more options in high performance, increased sensitivity, semiconducting materials used as temperature dependent resistors and in microbolometers for infrared imaging and detection.

The present invention provides a "drop in" replacement of semiconducting materials and a significant improvement in current semiconducting materials for resistors and microbolometer technology.

SUMMARY OF THE INVENTION

A primary objective of the present invention is to provide thin films suitable for replacing the temperature sensing material in conventional resistors.

A secondary objective of the present invention is to provide thin films suitable for replacing the temperature sensing material in conventional microbolometers.

A third objective of the present invention is to provide a synthetic method for the formation of thin films suitable for replacing the temperature sensing material in conventional microbolometers.

A fourth objective of the present invention is to provide an improved semiconducting material that provides a large negative temperature coefficient of resistance characteristic of large bandgap semiconducting materials in materials having significantly reduced resistivity.

A fifth objective of the present invention is to provide improved performance of infrared imaging microbolometers.

A sixth objective of the present invention is to provide improved performance of electronic sensor applications.

A seventh objective of the present invention is to provide a thin-film structure consisting of crystalline regions of noble metal within an amorphous semiconducting oxide.

A preferred resistor includes a mixture of a high resistivity material and a low resistivity material combined such that the change in resistance with temperature of the composite material is substantially that of the high resistivity material and that the resistance of the composite materials is intermediate to that of the high resistivity materials and that of the low resistivity material.

The preferred resistor is in the form of a thin film and consists of two materials that are combined as a nanocomposite material.

It is also preferred that the resistor is formed by simultaneous deposition of both materials, wherein the high resistivity material is a semiconductor and the low resistivity material is a metal; preferably, the semiconductor is an amorphous oxide and the metal is a noble metal.

A more preferred resistor includes a thin film of an amorphous oxide in combination with a noble metal, wherein the amorphous oxide is an oxide of vanadium and the metal is selected from the group consisting of: gold, platinum, palladium, indium, gallium, copper, and silver.

A preferred process for improving the electrical properties of an amorphous oxide-noble metal thin film resistor includes the simultaneous deposition of an amorphous oxide and a noble metal using thin film deposition sources to form a nanocomposite layer.

The preferred process of forming a thin film resistor includes the steps of selecting a vessel having a main reaction chamber with a plurality of sputter gun targets and a load lock chamber, selecting a plurality of sputter guns connected to a power supply and directed to the plurality of sputter gun targets, selecting a first set of shutters that are integrated into each of the sputter guns, selecting a second set of shutters that cover a deposition source in the main reaction chamber, operating the load lock chamber to isolate the main reaction chamber from exposure to the atmosphere, controlling the pressure of gases inside the main reaction chamber forming a vacuum condition to eliminate contaminants, using a magnetically coupled load arm to deliver a sample of amorphous oxide and noble metal material to the plurality of sputter gun targets in the main reaction chamber, isolating the sample of amorphous oxide and noble metal material from the deposition substrate by the second set of shutters, activating the power supply to operate the plurality of sputter guns directed to the sputter gun targets loaded with amorphous oxide and noble metal material, depositing a thin film of amorphous oxide and noble metal material onto the deposition substrate while the first set of shutters on the plurality of sputter guns blocks the stream of material from exiting each gun, and transferring the thin film on the deposition substrate from the main reaction chamber through the load lock chamber for removal of the thin film and evaluation as a resistor.

The preferred process for forming a thin film resistor, further includes the step of rotating the sample of amorphous oxide and metal material about a central axis during the deposition process, wherein the amorphous oxide is selected from the group consisting of oxides of vanadium and amorphous silicon and the metal is selected from the group consisting of: gold, platinum, palladium, indium, gallium, copper, and silver The preferred structure of a thin film resistor includes an amorphous semiconducting oxide having crystalline regions of a noble metal within the amorphous oxide; the amorphous oxide is vanadium oxide and the crystalline noble metal is gold.

A preferred method for fabricating vanadium oxide-noble metal thin film composites includes selecting a processing vessel a first chamber and a second chamber, coating a plurality of substrates with thermally insulating membranes, mounting the plurality of substrates on a holder in the first chamber, allowing oxygen and argon to flow until the flow and the second chamber pressure stabilizes, loading the mounted substrates into the second chamber with vanadium and a noble metal, applying power to the vanadium noble metal target, depositing removably a thin film of vanadium oxide noble metal on the substrate inside the second chamber, and removing vanadium oxide noble metal thin film composites for use in infrared imaging and detection.

The preferred method uses a first chamber is a load lock chamber and a second chamber that is a main processing chamber, wherein the noble metal is selected from at least one of platinum (Pt) and gold (Au) and the vanadium oxide noble metal is gold (Au) addition to vanadium oxide; the vanadium oxide is selected from at least one of $VO_2$, $V_2O_3$ and $V_2O_5$.

A preferred composition of matter that is useful as a nanocomposite microbolometer thin film consists of vanadium oxide with noble metal clusters prepared by reactive magnetron sputtering, wherein the noble metal clusters are selected from at least one of platinum (Pt) and gold (Au), more preferably, the noble metal clusters are gold (Au).

The preferred composition of matter has thermal coefficient resistance (TCR) values and low resistivity that increase the sensitivity of a microbolometer used in infrared imaging and detection.

Further objects and advantages of the present invention will be apparent from the following detailed description of a presently preferred embodiment which is illustrated schematically in the accompanying drawings.

DESCRIPTION OF THE PREFERRED EMBODIMENTS

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

Acronyms and abbreviations used herein are listed and explained below:

| | |
|---|---|
| $Ar/O_2$ | Argon/Oxygen Gas Mixture |
| Ar | Argon Gas |
| Au | Gold |
| C. | Degree in Celsius |
| CMOS | Complementary Metal Oxide Semiconductor |
| DC | Direct Current |
| Eg | Activation Energy |
| IR | Infrared |
| $O_2$ | Oxygen |
| PC | Personal Computer |
| Pt | Platinum |
| RF | Radio Frequency |
| RGA | Residual Gas Analysis |
| ROIC | Read Out Integrated Circuit |
| Rs | Sheet Resistance |
| SCCM | Standard Cubic Centimeter per Minute |
| T | Temperature |
| TCR | Temperature Coefficient Resistance |
| V | Vanadium |
| VOx | Vanadium Oxide |

Incorporated herein by reference is an in depth study of the physical and electrical properties of vanadium oxide as a semiconductor material by Vu Huynh Lam in "Electrical Properties of Reactive Magnetron Sputtered Vanadium Oxide Thin Films," Master's Thesis, University of Central Florida, School of Electrical Engineering and Computer Science, Orlando, Fla., (2006) (Unpublished).

Vanadium oxide is a semiconductor material that is well established for infrared sensors. It is well known that vanadium oxide can take many forms; more than 10 distinct oxide phases with different electronic properties, ranging from metallic to insulating, and a number of vanadium oxides undergo metal-insulator transitions at different temperatures. Vanadium dioxide, for example, exhibits such a transition at T=340 K. However for this invention, only the amorphous phase is used in the preparation of thin films. Vanadium oxide ($VO_x$) is used to symbolize vanadium-oxygen compounds in the amorphous phase, a preferred material over other semiconductors due to its non-hysteretic response and high temperature coefficient of resistance (TCR) with respect to its resistivity values. However, the present invention may use other semiconducting materials, such as, but not limited to amorphous oxides and amorphous silicon, and specifically may use an amorphous oxide such as, but not limited to, vanadium oxide in a variety of vanadium-oxygen compounds.

Both TCR and resistivity are two important parameters that determine the performance and sensitivity of microbolometer thin films used in infrared imaging. In general, a high TCR value is accompanied by a high resistivity. Ideally, the semiconductor material preferably would obtain high TCR with low resistivity. The present invention provides a novel nanocomposite microbolometer thin film with high TCR value and low resistivity.

Figure 1:
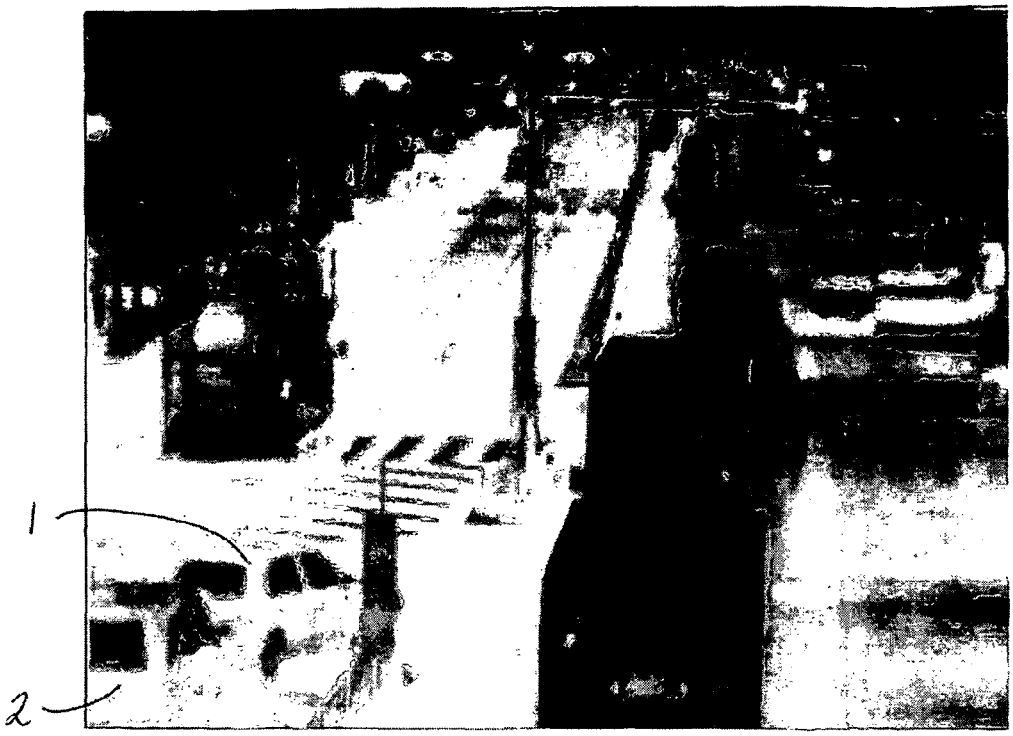
Fig. 1 (Prior Art)
FIG. 1 is an example of an infrared image (Prior Art).
Figure 2:
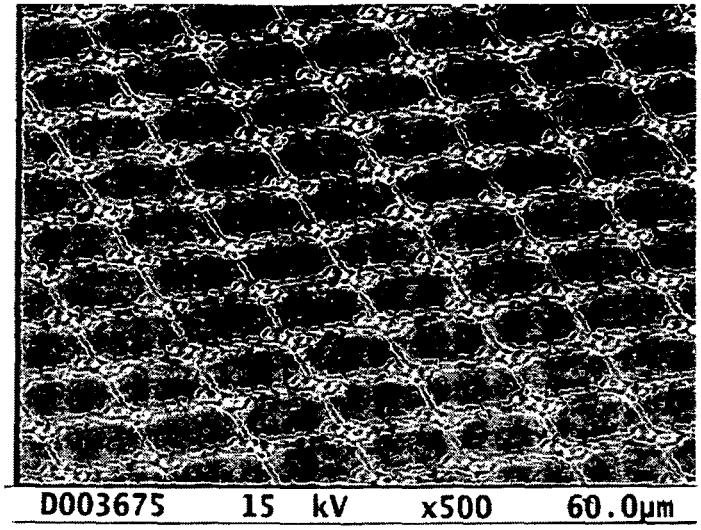
Fig. 2 (Prior Art)
FIG. 2 shows the focal plane array of microbolometers used to absorb infrared radiation. (Prior Art)

FIG. 2 is a focal plane array of microbolometers used to absorb infrared radiation. Each microbolometer has a thermal sensitive layer that changes its sheet resistance with temperature. A thin film of a semiconductor material, such as silicon or vanadium oxide forms a substrate sensor layer to detect and measure radiation, such as, visible light, infrared radiation, and ultraviolet radiation in amounts as small as one millionth of an erg.

The basic operation of a bolometer can be described as follows. Infrared radiation is emitted and absorbed through a bolometer that changes the resistance of the bolometer thin film. This change in resistance is converted into an image by the CMOS Read out Integrated Circuit (ROIC) below the surface of the thin film. A microbolometer has a micro-bridge structure that is uniquely designed for infrared detection as shown in FIGS. 3 and 4.

Figure 3:
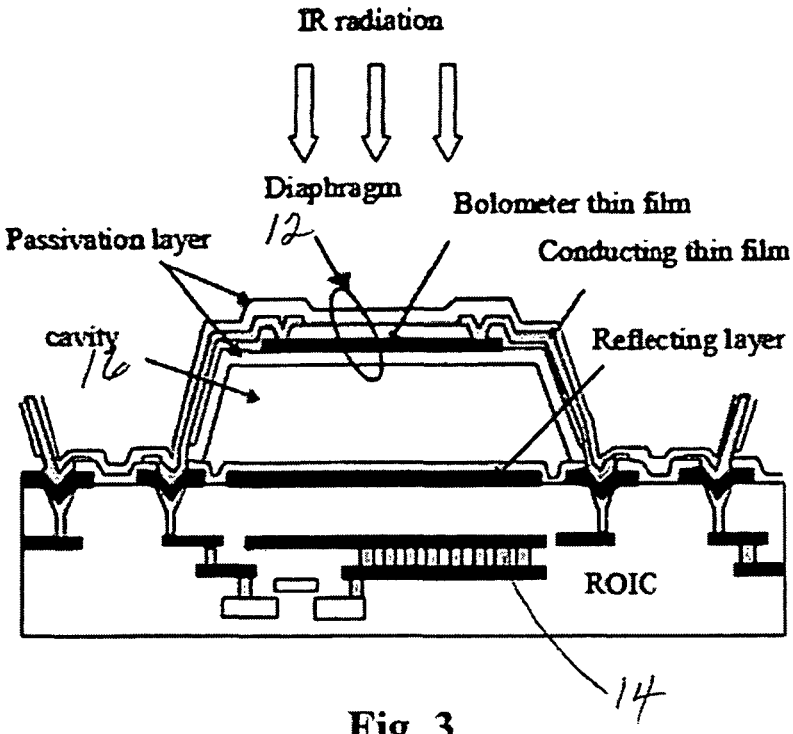
Fig. 3 (Prior Art)
FIG. 3 is an enlarged image of a microbolometer having a micro-bridge structure. (Prior Art)
Figure 4:
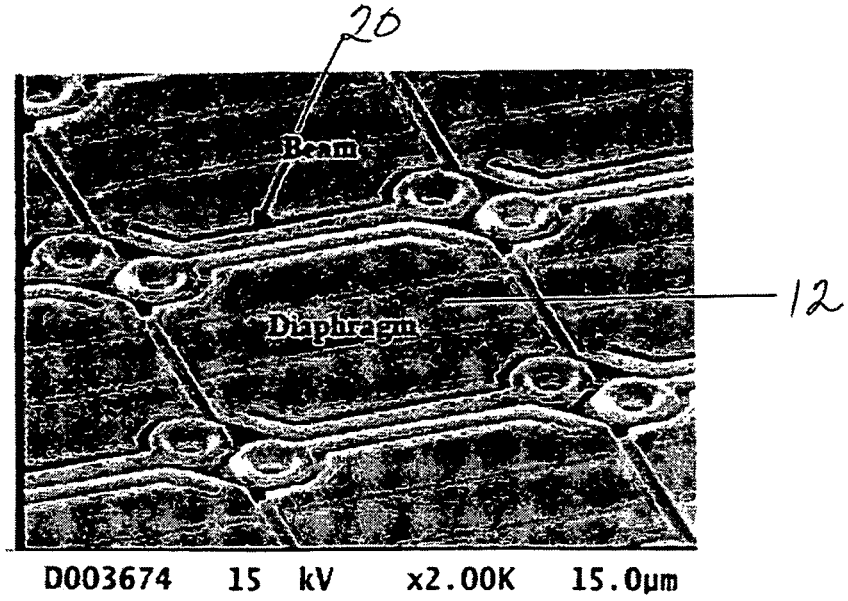
Fig. 4 (Prior Art)
FIG. 4 is a drawing of the structure of a microbolometer. (Prior Art)

In FIG. 3, the bridge structure 10 prevents heat from escaping through the CMOS ROIC and sustains good sensitivity of the bolometer. The diaphragm 12 is hovered above the integrated circuit 14 to maintain a good thermal isolation. The cavity 16 beneath the diaphragm 12 is designed to have a distance of $\frac{1}{4}\lambda$ to improve infrared absorption. Also, the beam 20 in FIG. 3 supporting the diaphragm 12 is designed to have an appropriate distance in order to optimize heat transportation. If the arm of beam 20 is too long, the heat obtained will slowly disperse which causes poor imaging when the next infrared radiation arrived. If the arm of beam 20 is too short, the heat will quickly escape and device sensitivity will be decreased. An ideal bolometer material would have high temperature coefficient of resistance (TCR) and low resistivity to maintain high sensitivity.

Vanadium oxide has been established and is well recognized to be a material that has a high resistivity change with temperature and is suitable for bolometer fabrication. In the present invention, vanadium oxide thin films have been deposited using DC magnetron sputtering method and the electrical properties were characterized such as TCR and resistivity. The deposited vanadium oxide displayed high TCR values with low resistivity. However, in order to improve the sensitivity of the bolometer thin film, resistivity of vanadium oxide films can be further reduced. For this purpose, noble metals such as platinum and gold are used to co-sputter with vanadium to deposit vanadium oxide. Platinum doped vanadium oxide yields a great reduction in resistivity, however, its TCR values also reduced as well. Unlike platinum, gold doped vanadium oxide presents a smaller reduction in resistivity but maintains high TCR values.

An alternative method to reduce resistivity of vanadium oxide is by lowering the percentage of oxygen concentration while sputtering from vanadium metal targets. However, this provides a lower resistivity and a lower TCR and does not, by itself, present an improvement. The results presented in this invention provide a new relationship between the TCR and resistivity values which makes it a novel method to develop an ideal material for bolometer thin film.

Both TCR and resistivity are two important parameters that determine the performance of the bolometer thin films used in infrared imaging. Unfortunately, the TCR of semiconductors has a simple physical limit which determines their performance for bolometer thin films. In general, a higher TCR value is accompanied by an extremely high resistivity. For example, intrinsic silicon can be used to demonstrate the TCR and resistivity relationship with respect to hypothetical changes in band gap energy. The resistivity of intrinsic silicon at room temperature can be written as follows:

$$\rho = \frac{m}{ne^2\tau} \propto e^{\frac{Eg}{kT}} \tag{1}$$

where m is the effective mass, n is the thermally activated intrinsic carrier concentration of silicon, e is the electron charge, $\tau$ is the mean free time, Eg is the band gap energy, k is Boltzmann constant, and T is the temperature. With this equation, resistivity can be viewed as a function of band gap energy. This approach can be also applied to calculate the TCR values of intrinsic silicon, $$\alpha = \frac{1}{R}\frac{dR}{dT} \tag{2}$$

where $\alpha$ is the TCR value, and R is the resistance of the film. R can also be expressed as follows, $$R = R_O e^{\frac{Eg}{kT}} \tag{3}$$

where Ro is the resistance at room temperature. The TCR equation can be further simplified as follows, $$\alpha \approx \frac{-Eg}{kT}\frac{1}{T} \propto Eg \tag{4}$$

Figure 5:
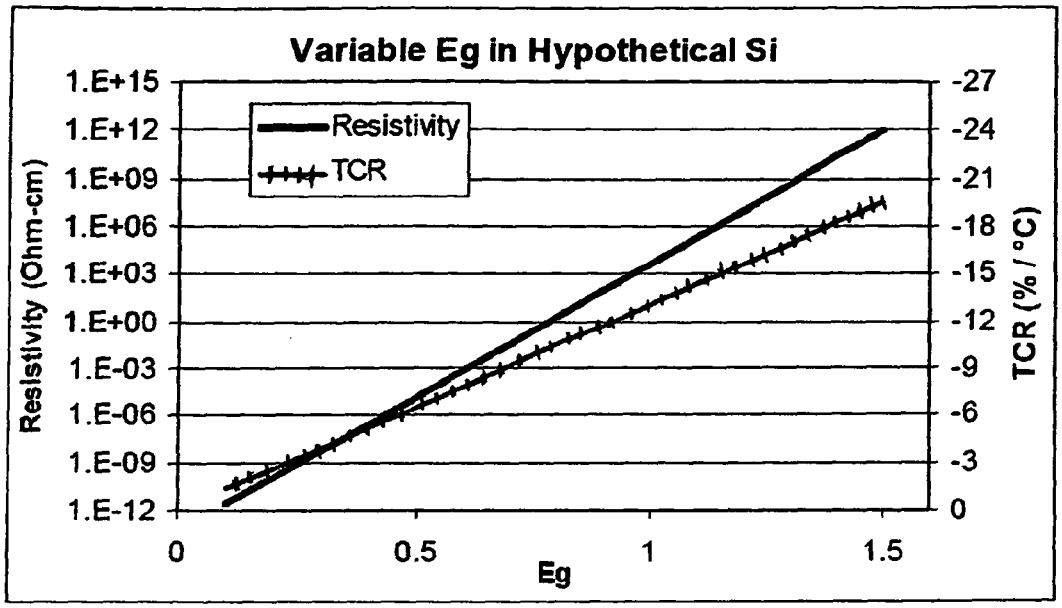
Fig. 5 (Prior Art)
FIG. 5 is a graph showing the physical limits of Temperature Coefficient of Resistance (TCR) of hypothetical intrinsic silicon at room temperature having a range of different band gap energies ($E_g$) (Prior Art)

FIG. 5 illustrates TCR and resistivity values of hypothetical intrinsic silicon at room temperature having a range of different band gap energies. This shows that large band gap semiconductors can have very high TCR values; however, their resistivity will be very high as well. Bolometer thin films are required to have high TCR in order to maintain high sensitivity but to also have low resistivity for compatibility with low noise readout for infrared imaging devices. From FIG. 5, it can be seen that large band gap semiconductors can be used as a sensor materials with high TCR values, but the high resistivity will not be compatible with readout electronics. Amorphous vanadium oxide is a preferred semiconductor material for infrared imaging bolometer thin film applications due to it relatively high TCR at modest resistivity, and because it can be processed at the relatively low temperatures (<200° C.) required for integration in imaging systems.

Vanadium oxides can have multiple stoichiometries and can be categorized based on their structures as crystalline or amorphous. Research has been performed to study these properties of both types of structures. Crystalline vanadium oxide has shown a dramatic resistivity vs. temperature effects due to a semiconductor to metal phase transition. When the temperature rises over a transition point, the crystal structure of $VO_2$ will change from a monoclinic phase into tetragonal rutile phase. At the same time, high optical transmission of the crystalline vanadium oxide will change to low optical transmission. Different compositions of crystalline vanadium oxides experience phase transitions at different temperatures.

Figure 6:
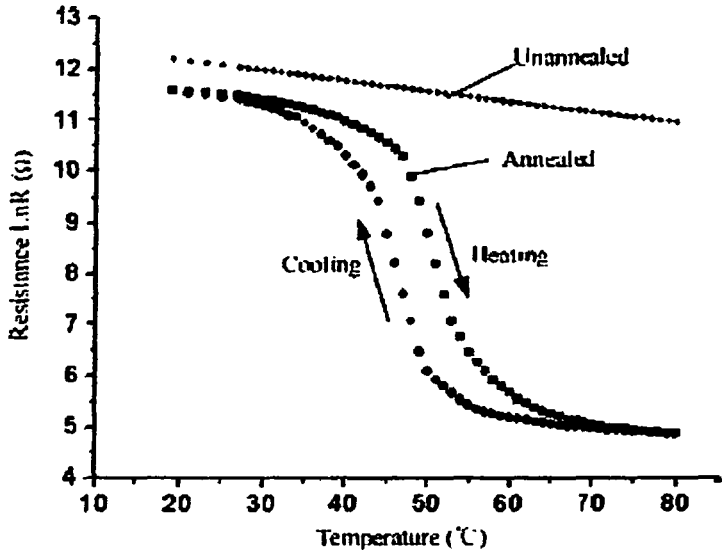
Fig. 6 (Prior Art)
FIG. 6 is a graph showing hysteretic property of crystalline vanadium oxides and non-hysteretic property of amorphous vanadium oxides.

For example, when the temperature reaches 68° C., $VO_2$ undergoes a phase transition as shown in FIG. 6. $V_2O_3$ has a different crystal structure and also undergoes a phase transition, at the much lower temperature of −134° C. $V_2O_5$ has yet another structure and changes to metallic state at higher temperature, 250° C.

For crystalline $VO_2$, the resistance can drop 5 orders of magnitude at the transition temperature, which makes it very attractive to many applications such as photoelectric switch, solar control, and defense laser radiation. Unfortunately, this phase transition is hysteretic. FIG. 6 illustrates the hysteretic property of crystalline (annealed) $VO_2$ as compared to the amorphous $VO_x$ (un-annealed). For example, $VO_2$ undergoes a phase transition at 68° C. as discussed above. Its resistance will decrease. However, when the resistance is at the mid point of the transition, a temperature change has no effect on its resistance. The imaging performance of a bolometer thin film will suffer greatly due to this property. Unlike crystalline $VO_2$, the amorphous $VO_x$ does not incorporate this property as FIG. 6 illustrates. Its resistance changes according to the change of temperature in a reversible and approximately linear fashion. When the temperature is heating up or cooling down, the resistance value will change accordingly.

Thus, amorphous $VO_x$ is a better choice for sensor applications for its non-hysteretic property. Many applications have used amorphous $VO_x$ as a sensor material due to it high TCR value and low resistivity. Such applications include light detectors, surveillance, night vision, detection of gas leakage, infrared detectors, and thermochromic smart windows. Many other amorphous semiconductors have been studied as alternative films for bolometer applications. Such materials include amorphous silicon, yttrium barium copper oxide (YBCO), and amorphous germanium, and these are also candidate semiconducting materials for the realization of this invention. So far, amorphous vanadium oxide is the preferred material for bolometer applications and is chosen as an illustrative example of the invention.

Figure 7:
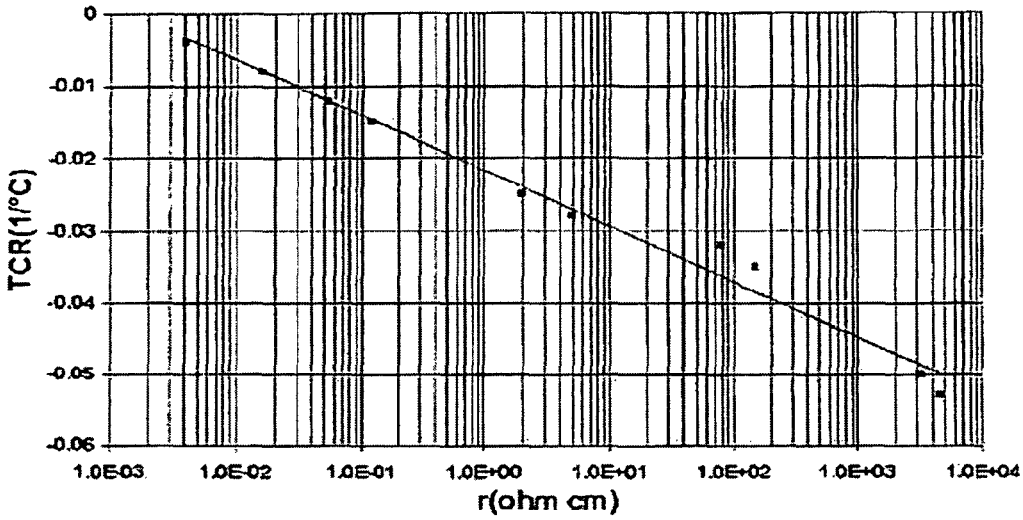
Fig. 7 (Prior Art)
FIG. 7 is a graph showing the relationship between thermal coefficient resistance (TCR) and resistivity values of amorphous vanadium oxide formed by dual ion beam sputtering technique. (Prior Art)

FIG. 7 illustrates the relationship between TCR and resistivity values of amorphous $VO_x$ formed by the dual ion beam sputtering technique and reported by Zintu et al in *Infrared Physics & Technology* 43 (2002) pages 245-250 supra. FIG. 7 shows the trend of increasing TCR with increasing resistivity expected of semiconductors. FIG. 7 is used as a reference in the development of an improved vanadium oxide with higher TCR and/or lower resistivity than that shown in FIG. 7. Poorly performing vanadium oxide will have a lower TCR and/or higher resistivity.

A variety of deposition techniques have been used to develop vanadium oxides; however, the most common and simplified technique to develop vanadium oxide is reactive magnetron sputtering deposition. With this technique, crystalline and amorphous vanadium oxide can be formed.

Other parameters that are used to control the crystal structure of vanadium oxide are the temperature and the oxygen concentration during and after deposition. The most common technique found in literature is to anneal the deposited vanadium oxide sample in oxygen/argon ambient at high or low temperature to yield a crystalline film. Annealing can also be performed to modify the properties of amorphous vanadium oxide films. Studies have been performed to develop vanadium oxide with a different range of temperatures and different percentages of oxygen concentration to yield variety of vanadium oxide compositions. These compositions can be either crystalline or amorphous. The compositions of the crystalline materials are $VO_2$, $V_2O_3$, and $V_2O_5$. Elevated temperature, in the range of 200° C. to 500° C., can be used during deposition or during post-deposition annealing to promote crystallization of the vanadium oxide sample. The percentages of oxygen can range from 6% to 50%. Within these ranges of temperature and oxygen, the resulting vanadium oxide is typically crystalline.

The present invention is illustrated by the use of amorphous vanadium oxide/noble metal thin films, therefore, room temperature deposition in a low percentage of oxygen is used and no post-deposition annealing at high temperature is performed.

Reactive Magnetron Sputtering System

Sputtering processes normally use argon gas because argon does not react with the target material allowing thin films to be formed. The addition of a gas that reacts with the target material, such as oxygen, will form compounds of the material and the reactant. To determine how vanadium oxide is formed using reactive magnetron sputtering a reactive gas test was performed.

Figure 8:
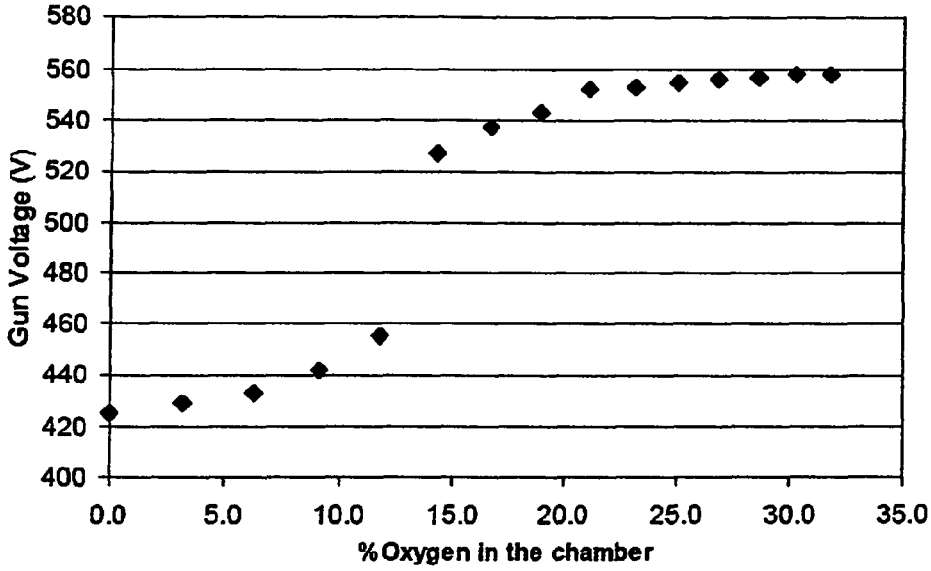
FIG. 8 shows the effect of different percentages of oxygen and voltage changes when a vanadium oxide target is sputtered.

Because the sputtering system uses a DC power supply that allows both voltage and current to float while maintaining constant power, the target voltage can be easily measured and used to infer changes in the impedance of the sputtering plasma. The gun in which the target is mounted is designed to provide a narrow range of impedance to the power supply. With the addition of a reactive gas the impedance of the target changes. Using the fixed conditions of 200 Watts of DC power and a chamber pressure of 4.0 mTorr while introducing increased amounts of oxygen the voltages were recorded. FIG. 8 illustrates the outcome of vanadium target sputtering in from 0% to 30.0% oxygen in the reaction chamber.

The plot of gun voltage vs. oxygen percentage has two distinct regions and a very sharp transition point. The lower voltage region, less than about 12.5% oxygen, corresponds to primary metallic vanadium target surface while for oxygen concentrations above 15% the target surface is fully oxidized.

In the metallic region, both argon and oxygen ions bombarded the target's surface to sputter away metallic vanadium atoms and those that have reacted with oxygen. With a small amount of oxygen concentration in the chamber both vanadium and vanadium oxide can be sputtered from the target surface. As these atoms condense on the substrate surface, further oxidation can occur to form an amorphous $VO_x$ thin film. As the oxygen concentration in the deposition chamber increases, the target surface begins to oxidize and will continue to oxidize until the entire surface is fully oxidized and it will become difficult to deposit a low resistivity film. For the present invention, it is preferred that low resistivity and high TCR values be maintained, thus the low oxygen concentration in a range of from approximately 0.025% to approximately 3.0%, is most preferred.

Figure 9:
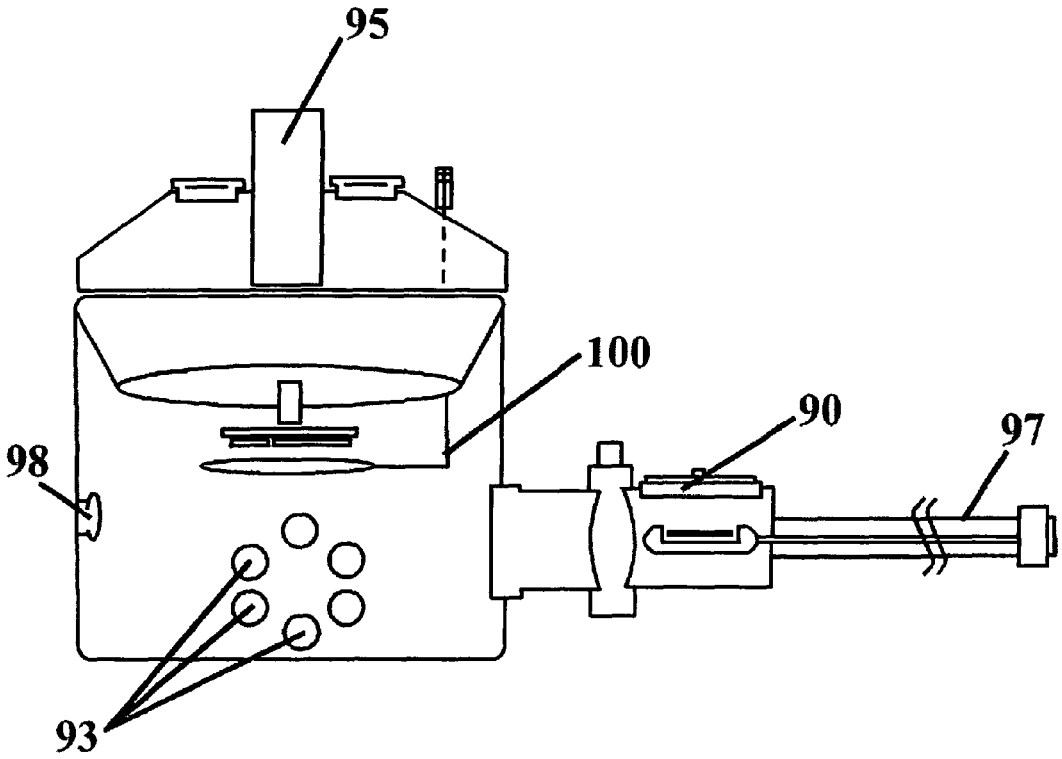
FIG. 9 is a schematic drawing of a system for reactive magnetron sputtering.

FIG. 9 illustrates the basic schematic of the sputtering system used to produce the thin film of the present invention. The sputter system has two chambers, a load lock chamber 90 and the main process chamber 95. The load lock chamber 90 is used to isolate the process chamber 95 from exposure to the atmosphere. A magnetically coupled load arm 97 is used to deliver/remove samples to/from the main chamber 95. The main chamber 95 has six sputter guns or targets 93 that are individually driven by four DC and 2 RF power supplies. The process pressure is maintained by a closed loop control system consisting of a variable gate valve and a capacitance monometer pressure sensor. Process gases are controlled by mass flow controllers and are independent of the chamber pressure controller.

A residual gas analyzer (RGA) 98 is used to measure the partial pressure of all the gases present inside the chamber. The sample is isolated from the deposition sources by a series of shutters (not shown). The primary shutters are integrated into each of the six individual sputter guns which block the stream of material from exiting each gun. The secondary or substrate shutter 100 covers the entire sample area and blocks the stream of material even if one or more of the individual gun shutters are opened. To produce a more uniform deposition the sample is rotated about a central axis throughout the deposition process.

The vacuum condition of the main chamber is critical to the outcome of the thin film depositions. For this reason prior to any deposition, the chamber is pumped down to less than $5.0\times10^{-8}$ Torr. In this pressure range most contaminates are eliminated. To accurately control the percentage of oxygen present in the chamber with a mixed gas consisting of 20% oxygen in argon and is supplied through one mass flow controller and is diluted with 100% argon gas supplied by a second mass flow controller. To calculate the flow rate of the mixed gas the following formula is used.

$$D = \frac{Xi * Ai}{0.2 - 0.8 * Xi} \tag{5}$$

Equation (5) was used to calculate the flow of 20% oxygen in argon mixture in single vanadium target deposition. In the equation D represents the flow rate of 20% oxygen in argon mixture, Xi is the oxygen's percentage desired and Ai is the fixed 100% argon flow. Having determined the desired mixed gas flow one can begin the process. The process is started with allowing the oxygen and argon to flow until the flow and the chamber pressure stabilize. Once the gas is stabilized, the gun is turned on. When this occurs the reaction between oxygen and the vanadium cause the percentage of oxygen in the chamber to fall off. When the power is not yet applied to the target, the percentage of oxygen is proportional to the flow rate of oxygen. However, when power is applied to the target, much of the oxygen is consumed to form vanadium oxide. Hence, by controlling the flow rate at a constant rate of vanadium metal deposition, we can now control the percentage of oxygen inside the chamber during the deposition process.

For each deposition run, two substrates were coated, one substrate was a silicon base with 300 nm of $SiO_2$ and another substrate was a glass slide with 3 liftoff lines. The substrates are mounted on a holder that is transferred between the load lock 90 and the main chamber 95. The substrates are then deposited with vanadium oxide and removed for evaluation.

Figure 10:
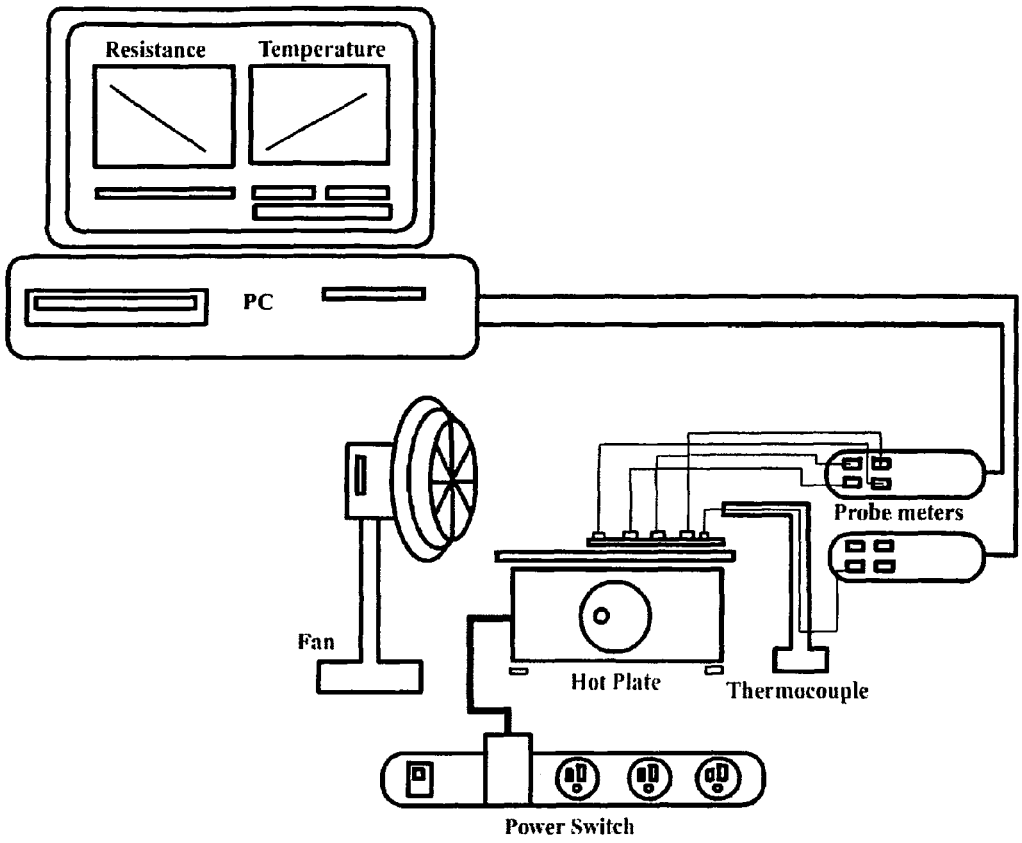
FIG. 10 is a schematic drawing of a system for temperature coefficient of resistance (TCR) measurement used in the present invention.

FIG. 10 illustrates the basic setting for TCR measurement. The vanadium oxide sample was placed on the surface of the hot plate 110 with the addition of a thermal conductive compound, such Thermal Joint Compound (Type 120, from Wakefield Engineering, Pelham, N.H. 03076) to provide adhesive and good thermal transfer between the two. The wires were connected to the current source/voltage meter 112 which measures the resistance of the film. A thermocouple 114 was placed on the surface of the film to measure its temperature. The temperature range for TCR measurement is about 2° C., referenced to room temperature. There are total of 350 data points recorded for 2° C., thus small fractions of temperature changed can be measured with respect to resistance. This method allows us to understand the sensitivity of the film with respect to temperature.

Both temperature and resistance data were recorded by use of a personal computer (PC)-based data acquisition system 115 which was also used to calculate each $VO_x$ sample's TCR value. After each TCR measurement is completed, the temperature of the hot plate is cooled back down to room temperature prior to the next measurement. A fan 120 and alcohol wipes are used to accelerate the cooling process. To summarize, a total of 3 TCR measurements are made for each sample and averaged for the final TCR value.

The examples below provide further detail on the fabrication and electrical properties of reactive magnetron sputtered vanadium oxide thin films.

Using the equipment configuration of FIG. 9, metal clusters are incorporated in the vanadium oxide thin film to reduce resistivity while maintaining its high Temperature Coefficient Resistance (TCR) values. Platinum and gold are the chosen noble metal candidates. It is to be understood that the present invention is not limited to noble metals, other suitable metals, such as, palladium, indium, gallium, copper, and silver may be used to form metal clusters in an amorphous film.

Figure 11:
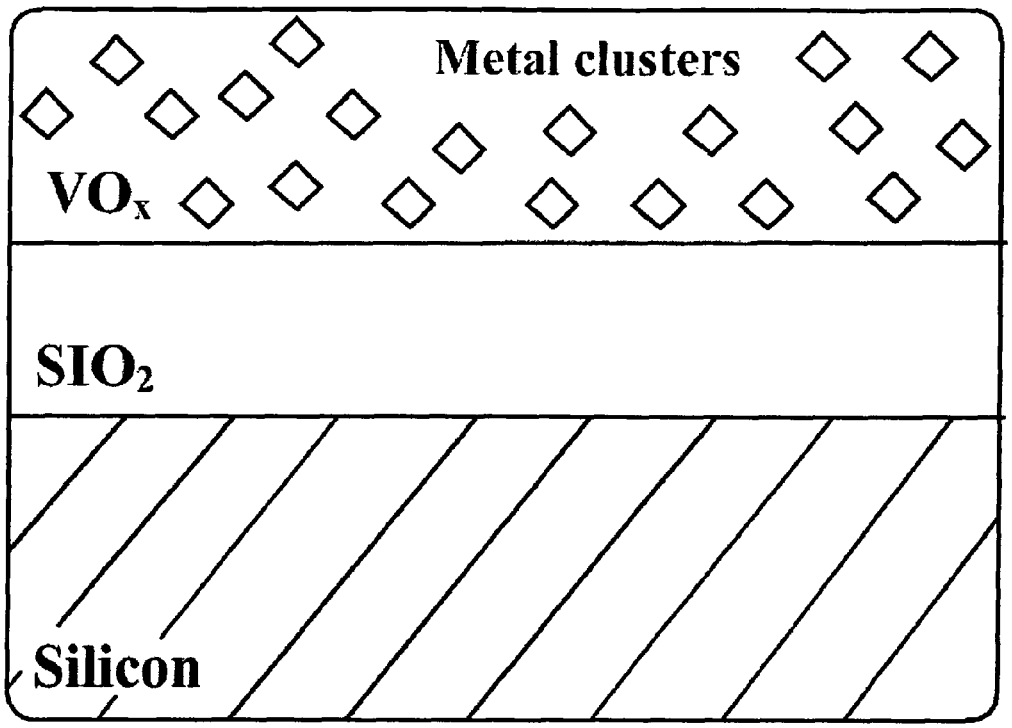
FIG. 11 is an idealized drawing of the addition of metal clusters to amorphous vanadium oxide thin film.

FIG. 11 illustrates the theory of metal additions to amorphous $VO_x$ thin film. Metal clusters inside the film can act as a partial short, which reduces resistivity. The composite resistivity is still determined by that of the $VO_x$ and still maintains the TCR value of the vanadium oxide thin film. Reactive magnetron co-sputtering of noble metals with vanadium was carried out at 0.5% oxygen in the chamber because the low oxygen concentration favorably affects low resistivity and the most stable TCR values.

In addition to determining that resistivity can be further reduced by introducing metallic regions inside the amorphous $VO_x$ thin films, forming a nanocomposite thin film, it was also determined that reaction chamber conditions and background gas also have an impact on the properties of the $VO_x$ thin films. The metallic regions inside the amorphous oxides are preferably, noble metals, such as, but not limited to platinum and gold. In general, a wide range of semiconducting materials with different metallic regions may be useful embodiments of this invention, but care must be taken in the choice of the specific semiconducting and metal materials, or in the processing of the materials, that the properties of the semiconductor material are not excessively degraded by contact with the metal, and vice versa.

Example 1

Platinum (Pt) Co-Sputtered with Single Vanadium Target

Using the equipment configuration of FIG. 9, platinum metal is incorporated in the vanadium oxide thin film. Platinum incorporated in the film in this manner is apparently amorphous.

Figure 12:
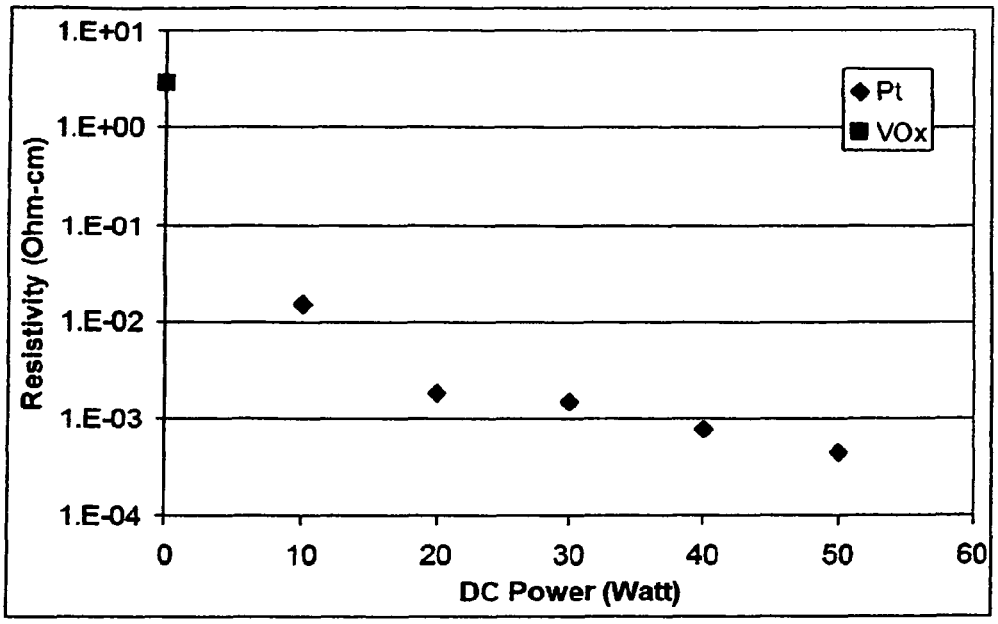
FIG. 12 is a graph of resistivity vs. direct current (DC) power of platinum additions to vanadium oxide thin films.
Figure 13:
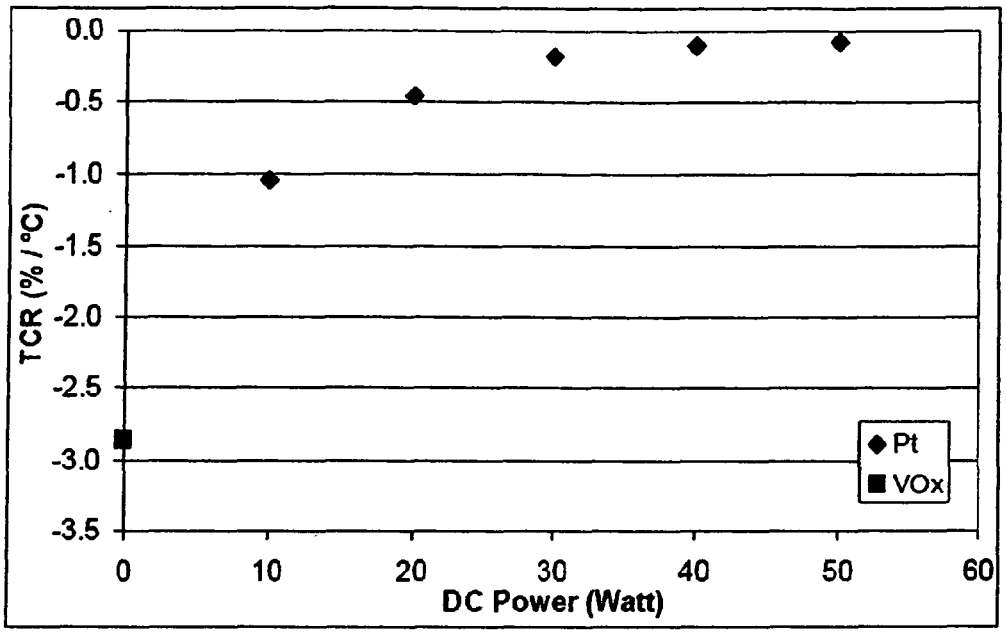
FIG. 13 shows Temperature Coefficient Resistance (TCR) vs. DC power of platinum additions to vanadium oxide thin films.
Figure 14:
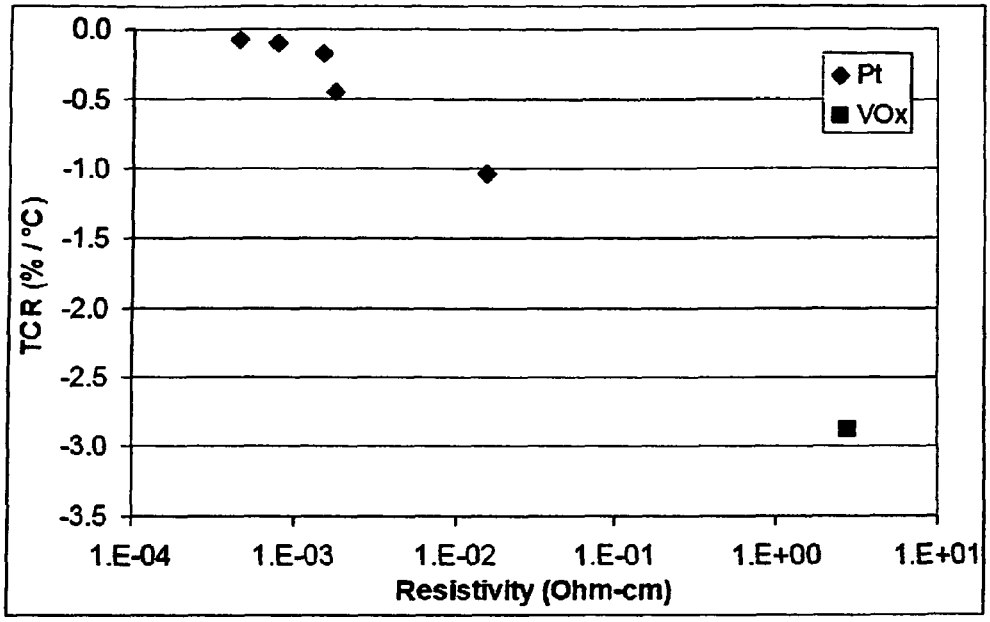
FIG. 14 is a graph showing Temperature Coefficient Resistance (TCR) vs. resistivity for platinum additions to vanadium oxide thin films.

Based on this experiment, platinum can improve vanadium oxide film's resistivity; however, TCR values dropped undesirably. FIG. 12 shows the decrease in resistivity with platinum additions to vanadium oxide. FIG. 13 shows that TCR values drop at least 2% per degree centigrade (° C.) when a small amount of platinum is incorporated in the vanadium oxide film. Thus, platinum additions to vanadium oxide in this manner appear not to result in an improved material for bolometer application as shown in FIG. 14 where platinum additions represented by the diamond shape on the graph show low TCR and high resistivity. Thus, platinum additions reduce resistivity and platinum additions also reduce TCR, therefore, platinum additions to vanadium oxides in this manner is not a preferred metal to improve properties of microbolometer thin films. Other means to introduce platinum, for example by deposition onto heated substrates and/or annealing after deposition may be successful in improving both resistivity and TCR. Both deposition onto heated substrates and annealing after deposition are also known to result in the undesirable crystallization of vanadium oxides is the temperature is too high, but some benefit for Pt additions at an intermediate temperature may be possible.

Example 2

Gold (Au) Co-Sputtered with Vanadium Target (I)

Using the equipment configuration of FIG. 9, gold is co-sputtered with the vanadium target. The deposition settings for gold are identical to platinum settings which were used for comparison purposes. The outcome of gold's resistivity with respect to DC power supply is illustrated in FIG. 15.

Figure 15:
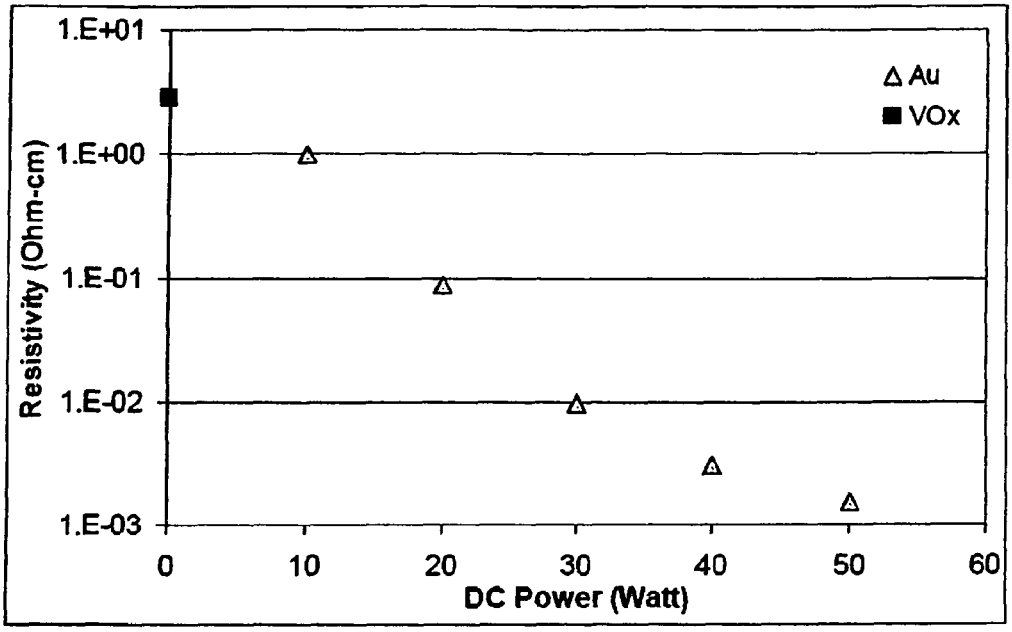
FIG. 15 shows resistivity vs. direct current (DC) power of gold (Au) additions to vanadium oxide thin films.
Figure 16:
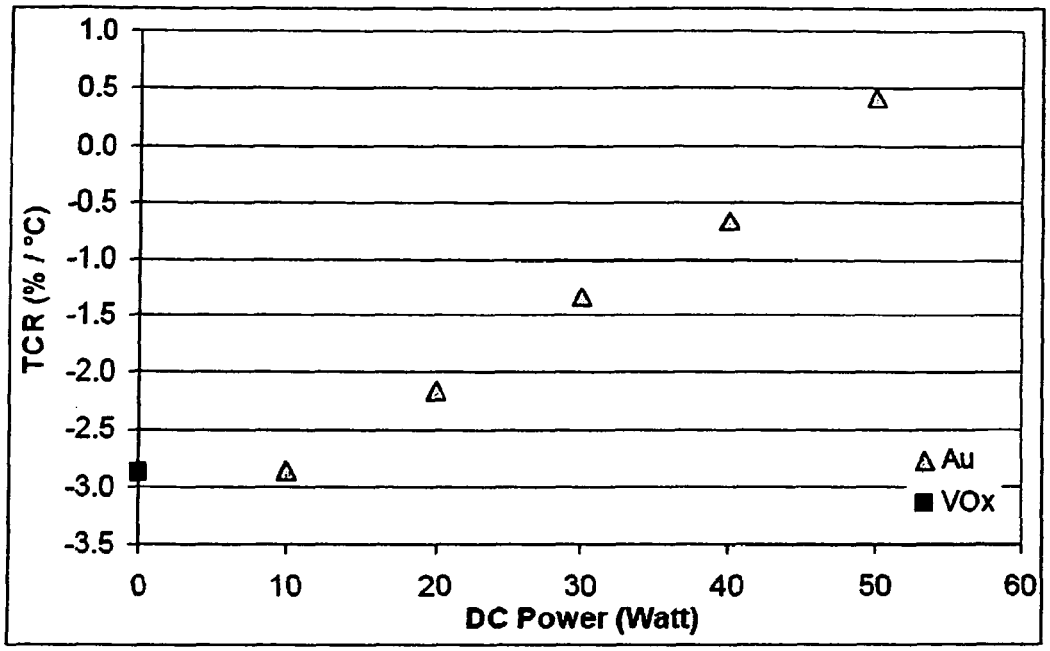
FIG. 16 is a graph showing Temperature Coefficient Resistance (TCR) vs. DC power of gold (Au) additions to vanadium oxide thin films.

In FIG. 15, the resistivity of gold samples reduces gradually compared to the platinum samples which indicate gold has a better control in term of resistivity. While the resistivity of the gold samples did not drop as much as that of the platinum samples, TCR values of gold samples showed a much more promising result, by remaining at a high level as shown in FIG. 16.

Significantly, the initial TCR value for the smallest gold addition to $VO_x$ was not reduced with respect to the pure vanadium oxide sample. These data show that gold additions to vanadium oxide can improve resistivity and still maintain high TCR values as illustrated in FIG. 17.

Figure 17:
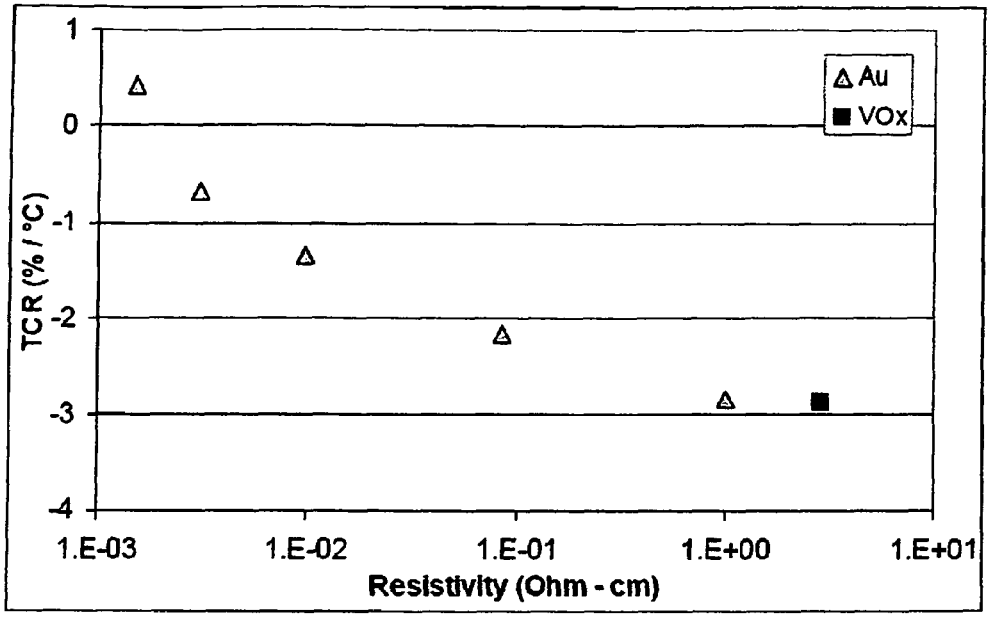
FIG. 17 is a graph showing Temperature Coefficient Resistance (TCR) vs. resistivity for gold additions to vanadium oxide thin films.

Gold additions have a more gradual resistivity effect and initially there is no reduction in TCR with gold additions as shown in FIG. 17. Gold additions to vanadium oxides yield lower resistivity and maintain high TCR values. Gold forms crystalline clusters (not amorphous) as desired and is a preferred metal to improve the properties of amorphous $VO_x$ thin films.

Example 2

Gold (Au) Co-Sputtered with Vanadium Target (II)

Figure 18:
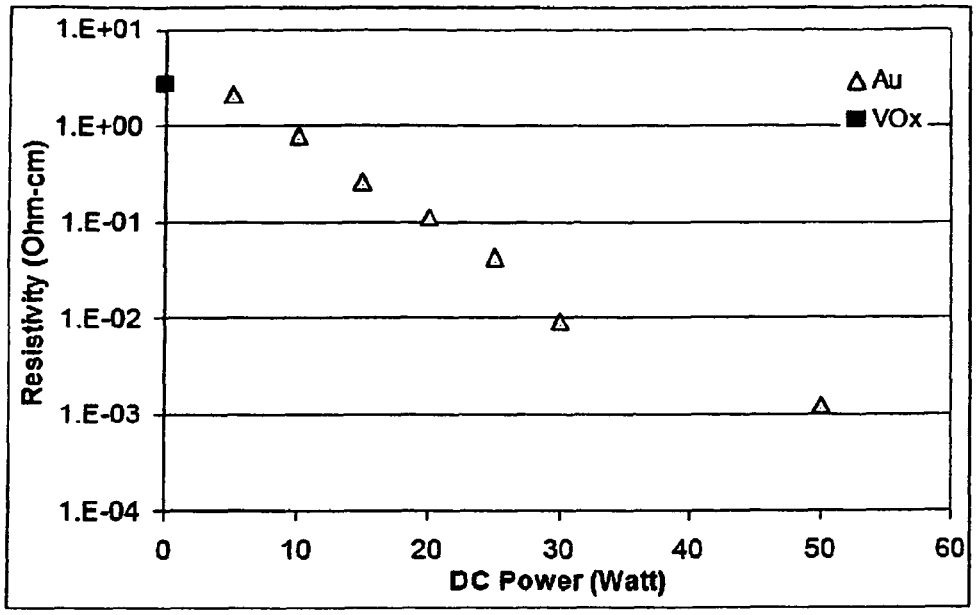
FIG. 18 is a graph showing resistivity vs. direct current (DC) power of gold additions to vanadium oxide, as a confirmation of results in FIG. 14.
Figure 19:
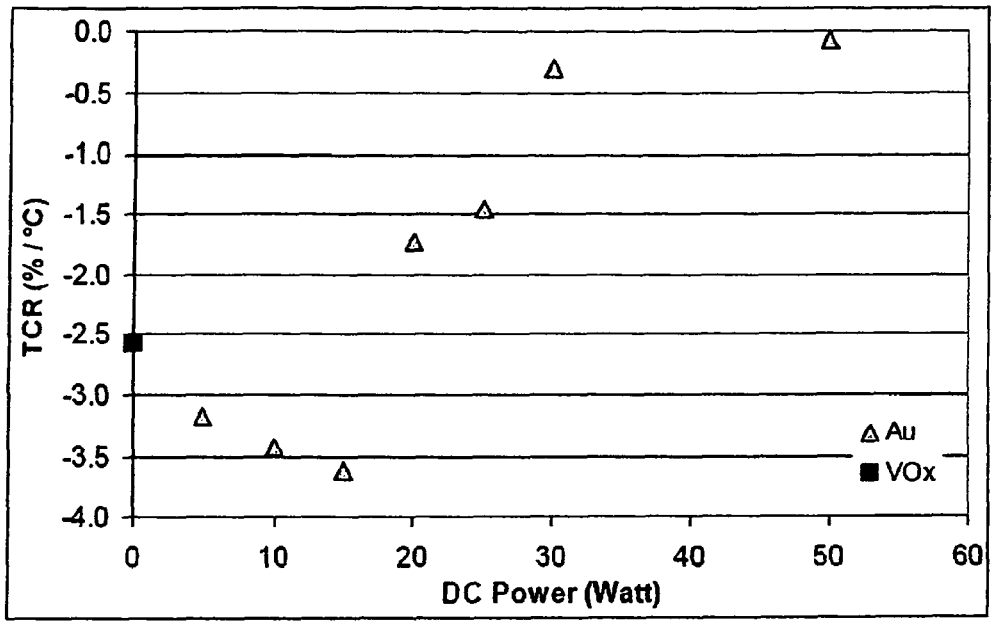
FIG. 19 is a graph showing Temperature Coefficient Resistance (TCR) vs. direct current (DC) power for gold additions to vanadium oxide, confirming results in FIG. 16.

In order to confirm the gold data are correct and reproducible, another set of gold addition samples was generated. The resistivity of the second gold series showed a gradual decrease, similar to the first gold series. However, TCR values of the second gold series showed a slightly different trend. FIGS. 18 and 19 illustrate the resistivity and TCR values vs. the DC power applied to sputter the gold target. The TCR values of the second gold series (II) were not fully consistent with the first series (I). DC power applied to gold at 5, 10, and 15 Watts show an opposite trend compared to the rest of the samples a higher power. The TCR measurement technique was suspected to cause this error.

Both gold series were re-measured in term of TCR; and during this process, the improved technique for TCR measurement was developed and established. The inconsistency of TCR values was caused by the variation in the residual heat within hot plate at the start of each measurement run. By removing all excess heat, equilibrium temperature was achieved; thus providing improved consistency for all the TCR measurements.

Figure 20:
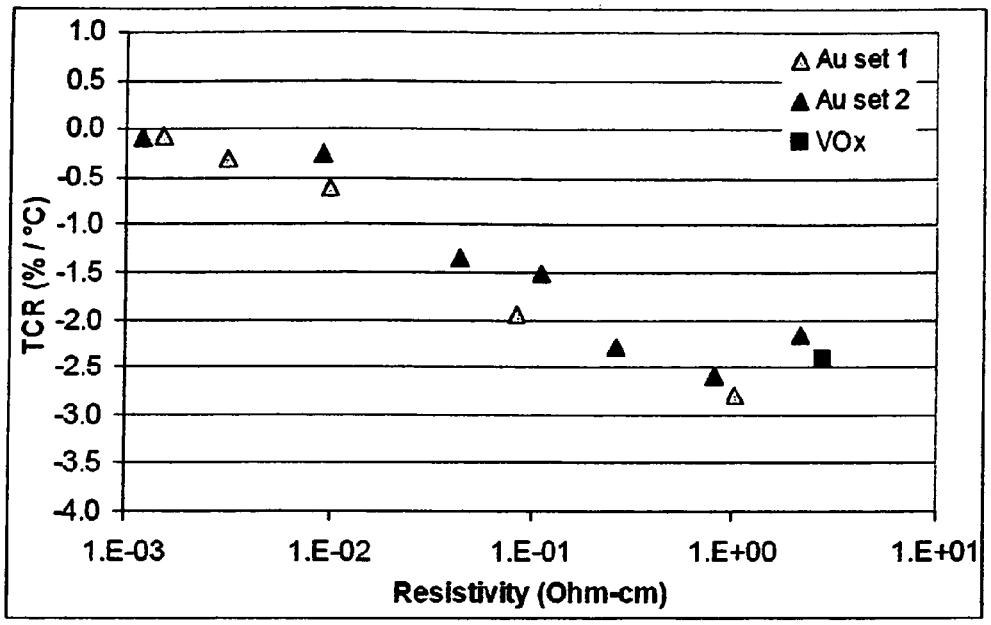
FIG. 20 is a graph showing Temperature Coefficient Resistance (TCR) vs. resistivity for a first set and a second set of gold additions to vanadium oxide thin films.

FIG. 20 confirms that the improved TCR measurement technique provides the ability to reproduce the data for both the first series (I) and second series (II) of gold co-sputtered vanadium oxide samples. The resistivity for both series match closely and the TCR values for both have a significantly reduced variation.

For both series, 10 Watts of DC power for gold yielded the highest TCR and the lowest resistivity when compared to the amorphous vanadium oxide sample. The repeatability of gold additions to amorphous vanadium oxide was successfully established with the improved values in terms of TCR and resistivity. The data from these experiments is summarized in Table I below.

TABLE I

Noble Metals Co-Sputtered Single Vanadium Target Depositions

| Samples | Thickness (m) | Rs (Ω/sqr) | % of O2 | Resistivity (Ω-cm) | 1st TCR (%/° C.) | 2nd TCR (%/° C.) |
|---|---|---|---|---|---|---|
| 050806 A (10W Pt) | 3.56E−08 | 4291.58 | 0.5 | 0.01528 | −1.0410 | |
| 050806 B (20W Pt) | 2.83E−08 | 635.16 | 0.5 | 0.00180 | −0.4540 | |
| 050806 C (30W Pt) | 7.40E−08 | 204.42 | 0.5 | 0.00151 | −0.1732 | |
| 050806 D (40W Pt) | 7.46E−08 | 104.58 | 0.5 | 0.00078 | −0.1017 | |
| 050806 E (50W Pt) | 7.54E−08 | 59.82 | 0.5 | 0.00045 | −0.0703 | |
| 081806 A (10W Au) | 5.20E−08 | 193400.83 | 0.5 | 1.00568 | −2.8470 | −2.7827 |
| 081806 B (20W Au) | 5.59E−08 | 15189.45 | 0.5 | 0.08491 | −2.1519 | −1.9214 |
| 081806 C (30W Au) | 8.63E−08 | 1133.41 | 0.5 | 0.00978 | −1.3388 | −0.6174 |
| 081806 D (40W Au) | 1.12E−07 | 277.86 | 0.5 | 0.00311 | −0.6729 | −0.3001 |
| 081806 E (50W Au) | 1.23E−07 | 123.19 | 0.5 | 0.00151 | 0.4213 | −0.0608 |
| 082306 A (00W Au) | 4.18E−08 | 660017.82 | 0.5 | 2.75887 | −2.5723 | −2.4043 |
| 082306 B (05W Au) | 4.64E−08 | 460300.13 | 0.5 | 2.13579 | −3.1707 | −2.1540 |
| 082306 C (10W Au) | 4.44E−08 | 178742.08 | 0.5 | 0.79361 | −3.4223 | −2.5910 |
| 082306 D (15W Au) | 5.71E−08 | 46489.48 | 0.5 | 0.26545 | −3.6166 | −2.2824 |
| 082306 E (20W Au) | 6.11E−08 | 18293.42 | 0.5 | 0.11168 | −1.7332 | −1.4941 |
| 082306 F (25W Au) | 7.81E−08 | 5597.36 | 0.5 | 0.04369 | −1.4552 | −1.3414 |
| 082306 G (30W Au) | 7.54E−08 | 1213.17 | 0.5 | 0.00914 | −0.2979 | −0.2566 |
| 082306 H (50W Au) | 1.28E−07 | 93.33 | 0.5 | 0.00120 | −0.0681 | −0.0836 |

Using noble metals co-sputtered with single vanadium target was a success in terms of finding a new technique to improve the properties of amorphous vanadium oxide.

It is a primary concern that the electrical properties of the vanadium oxide thin films exhibit reduced resistivity while maintaining high Temperature Coefficient Resistance (TCR) values. Amorphous vanadium oxide/noble metal thin films have been prepared that are suitable for replacing the amorphous material in conventional microbolometers.

The present invention provides a new technique for fabricating microbolometer thin films for infrared imaging. Techniques were used to control the amount of oxygen precisely during deposition. TCR measurement techniques are provided with improved repeatability and accurate results. The gold addition to amorphous vanadium oxide yields higher TCR and lower resistivity.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A process for improving the electrical properties of an amorphous oxide-noble metal thin film resistor comprising:

simultaneously depositing an amorphous oxide and a noble metal using thin film deposition sources to form a layer of nanocomposite material such that a change in resistance with temperature of the nanocomposite material is substantially that of the amorphous oxide and is intermediate to that of the noble metal.

2. The process of claim 1, that comprises the steps of:

selecting a vessel having a main reaction chamber with a plurality of sputter gun targets and a load lock chamber;

selecting a plurality of sputter guns connected to a power supply and directed to the plurality of sputter gun targets;

selecting a first set of shutters that are integrated into each of the sputter guns;

selecting a second set of shutters that cover a deposition source in the main reaction chamber;

operating the load lock chamber to isolate the main reaction chamber from exposure to the atmosphere;

controlling the pressure of gases inside the main reaction chamber forming a vacuum condition to eliminate contaminants;

using a magnetically coupled load arm to deliver a sample of amorphous oxide and noble metal material to the plurality of sputter gun targets in the main reaction chamber;

isolating the sample of amorphous oxide and noble metal material from the deposition substrate by the second set of shutters;

activating the power supply to operate the plurality of sputter guns directed to the sputter gun targets loaded with amorphous oxide and noble metal material;

depositing a thin film of amorphous oxide and noble metal material onto the deposition substrate while the first set of shutters on the plurality of sputter guns blocks the stream of material from exiting each gun; and transferring the thin film on the deposition substrate from the main reaction chamber through the load lock chamber for removal of the thin film and evaluation as a resistor.

3. The process of claim 2, further comprising the step of rotating the sample of amorphous oxide and metal material about a central axis during the deposition process.

4. The process of claim 3, wherein the amorphous oxide is selected from the group consisting of oxides of vanadium and amorphous silicon.

5. The process of claim 3, wherein the metal is selected from the group consisting of: gold, platinum, palladium, indium, gallium, copper, and silver.

6. A structure composition for a thin film resistor consisting essentially of:

an amorphous oxide-noble metal comprising co-dispersed amorphous oxide and a noble metal using thin film deposition source to form a layer of nanocomposite material having crystalline regions of a noble metal within the amorphous oxide such that a change in resistance with temperature is substantially that of the amorphous semiconducting oxide and is intermediate to that of the noble metal.

7. The composition of claim 6, wherein the amorphous oxide is vanadium oxide and the crystalline noble metal is gold.

8. A method for fabricating vanadium oxide-noble metal thin film composites comprising the steps of:

a) selecting a processing vessel a first chamber and a second chamber;

b) coating a plurality of substrates with thermally insulating membranes;

c) mounting the plurality of substrates on a holder in the first chamber;

d) allowing oxygen and argon to flow until the flow and the second chamber pressure stabilizes;

e) loading the substrates of step c) into the second chamber with vanadium and a noble metal;

f) applying power to the vanadium noble metal target;

g) depositing removably a thin film of vanadium oxide noble metal on the substrate inside the second chamber; and h) removing vanadium oxide noble metal thin film composites for use in infrared imaging and detection.

9. The method of claim 8, wherein the first chamber is a load lock chamber.

10. The method of claim 8, wherein the second chamber is a main processing chamber.

11. The method of claim 8, wherein the noble metal is selected from at least one of platinum (Pt) and gold (Au).

12. The method of claim 8, wherein the vanadium oxide noble metal is gold (Au) addition to vanadium oxide.

13. The method of claim 8, wherein the vanadium oxide is selected from at least one of $VO_2$, $V_2O_3$ and $V_2O_5$.

14. The process of claim 1 further comprising the step of:

controlling a temperature and a oxygen concentration during and after the depositing step to control a crystal structure of vanadium oxide.

15. The composition of claim 6, wherein the amorphous oxide is selected from the group consisting of oxides of vanadium and amorphous silicon.

16. The composition of claim 6, wherein the noble metal is selected from at least one of platinum (Pt) and gold (Au).

17. The composition of claim 7, wherein the vanadium oxide is selected from at least one of $VO_2$, $V_2O_3$ and $V_2O_5$.

18. The composition of claim 6, wherein the structure is a thin film.

19. The composition of claim 6, wherein the noble metal is selected from a group consisting of: gold, platinum, palladium, indium, gallium, copper, and silver.

20. A process for producing a resistor consisting essentially of:

co-dispersing a mixture of a high resistivity material with a low resistivity material to form a nanocomposite material combined such that the change in resistance with temperature of the nanocomposite material is substantially that of the high resistivity material and that the resistance of the nanocomposite materials is intermediate to that of the high resistivity materials and that of the low resistivity material.

* * * * *